United States Patent [19]

Schorey et al.

[11] Patent Number: 4,932,645

[45] Date of Patent: Jun. 12, 1990

[54] METHOD AND APPARATUS FOR CONTROLLING A MULTIPLE DELIVERY COLLATOR IN RESPONSE TO A DOWNSTREAM FAULT CONDITION

[75] Inventors: James E. Schorey, Kettering, Ohio; Jeffrey C. Cadow, West Roxbury, Mass.

[73] Assignee: AM International Incorporated, Chicago, Ill.

[21] Appl. No.: 329,983

[22] Filed: Mar. 29, 1989

[51] Int. Cl.[5] ..... B65H 43/02

[52] U.S. Cl. ..... 270/56; 270/54

[58] Field of Search ..... 270/52, 54, 55, 56, 270/57, 58; 271/258, 259, 288, 260, 261

[56] References Cited

U.S. PATENT DOCUMENTS

| | | | |
|---|---|---|---|
| 3,822,877 | 7/1974 | Littleton | 270/56 |
| 3,825,246 | 7/1974 | Elia et al. | 270/58 |
| 3,953,018 | 4/1976 | Maopolski | 270/55 |

*Primary Examiner*—Robert E. Garrett

*Assistant Examiner*—Therese M. Newholm

*Attorney, Agent, or Firm*—Tarolli, Sundheim & Covell

[57] ABSTRACT

An apparatus and method for controlling a collator having a plurality of delivery conveyors are disclosed. The collator includes a plurality of hoppers for feeding a plurality of signatures to a plurality of gathering stations or pockets which moves past the hoppers. An assemblage, i.e., a group of collated signatures is formed in each of the plurality of pockets. The plurality of delivery conveyors receives assemblages from the plurality of pockets during operation of the collator. If a fault condition is detected downstream of one of the plurality of delivery conveyors, then receipt of assemblages by the one delivery conveyor is interrupted while receipt of assemblages by the other of the plurality of delivery conveyors is maintained. The result is that only the one delivery conveyor with the downstream fault condition ceases delivering assemblages. All production from the collator does not cease. Production and delivery of assemblages onto the delivery conveyors with no fault condition are maintained.

5 Claims, 3 Drawing Sheets

METHOD AND APPARATUS FOR CONTROLLING A MULTIPLE DELIVERY COLLATOR IN RESPONSE TO A DOWNSTREAM FAULT CONDITION

TECHNICAL FIELD

The present invention relates to a collating machine having a plurality of delivery conveyors and is particularly directed to a method and apparatus for controlling such a collator in response to a fault condition downstream of one of the plurality of delivery conveyors.

BACKGROUND OF THE INVENTION

Collating machines for assembling a plurality of signatures into groups of collated signatures, such as books or magazines, are well known in the art. Electronic control circuitry for use in collators is also known in the art. A known collator having electronic control circuitry is disclosed in U.S. Pat. No. 3,825,246 (hereinafter referred to as the '246 patent). The '246 patent discloses a collator having a plurality of hoppers for feeding signatures in a sequence to a plurality of gathering stations in the form of pockets. The pockets move below the hoppers in a closed path. The hoppers feed a signature to the pockets as the pockets move under the hoppers.

A group of collated signatures, referred to herein as an assemblage, is formed in each of the pockets. The bottom of each of the pockets opens at a predetermined time synchronized with movement of the pockets under the hoppers. When the bottom of a pocket opens, the assemblage contained therein drops onto a delivery conveyor associated with the particular assemblage. In one embodiment disclosed in the '246 patent, the collator is divided into a plurality of sectors. Each sector has its own delivery conveyor. Thus, the number of delivery conveyors for receiving assemblages is equal to the number of sectors.

The electronic control circuitry of the collator monitors the plurality of hoppers for a misfeed to the plurality of pockets. If a misfeed occurs in one of the hoppers, then subsequent hoppers in the feed sequence are prevented from feeding to the misfed pocket. The misfed pocket continues to move in the closed path under the hoppers until the misfed pocket again moves under the hopper at which the misfeed occurred. This hopper then delivers its signature to the misfed pocket. After this pocket receives the signature, the pocket moves to subsequent hoppers to receive signatures therefrom. The result is that the misfeed condition which occurred earlier is corrected without having to stop the collator.

Although the collator disclosed in the '246 patent is able to detect and correct for an occurrence of a misfeed from a hopper without having to halt operation of the collator, the collator is unable to detect and correct for an occurrence of a fault condition downstream of one of the delivery conveyors without having to halt operation of the entire collator. If such a fault condition is detected, then the pockets are stopped so that the fault condition on the one delivery conveyor can be corrected. Since all the pockets are stopped, all delivery conveyors cease feeding and all production from the collator is stopped. This results in unnecessarily lost production from the collator sectors associated with delivery conveyors downstream of which there is no fault condition.

SUMMARY OF THE INVENTION

The present invention is directed to a method and apparatus for controlling a collator having a plurality of delivery conveyors. The collator includes a plurality of hoppers for feeding a plurality of signatures to a plurality of gathering stations as the gathering stations move past the hoppers. The plurality of delivery conveyors receives groups of collated signatures from the plurality of gathering stations during operation of the collator. A group of collated signatures is referred to herein as an assemblage. If a fault condition is detected downstream of one of the plurality of delivery conveyors, then receipt of assemblages by the one delivery conveyor is interrupted while receipt of assemblages by the other of the plurality of delivery conveyors is maintained. The result is that only the one delivery conveyor with the downstream fault condition ceases delivering assemblages. Thus, all production from the collator does not cease.

In a preferred embodiment of the present invention, a rotary turret supports a plurality of gathering stations in the form of pockets for movement of the pockets under a plurality of hoppers. The pockets move in a closed, rotary path passing underneath the hoppers. The collator is divided into a plurality of sectors each of which has one particular delivery conveyor. Thus, the number of sectors is equal to the number of delivery conveyors.

In operation, the plurality of hoppers feeds a plurality of signatures to the plurality of pockets. An assemblage is formed in each of the pockets. The bottom of each pocket opens at a predetermined time synchronized with movement of the pockets along the closed, rotary path under the hoppers. When the bottom of a pocket opens, the assemblage contained therein drops onto its associated delivery conveyor. The delivery conveyor carries the assemblage downstream to some type of handling mechanism such as a stacker. Each downstream handling mechanism has an associated detector for detecting a fault condition downstream of the particular delivery conveyor.

If a fault condition is detected downstream of one of the delivery conveyors, an electrical signal indicative thereof is generated. A microcomputer monitors the detectors for an indication of a fault condition downstream of one of the delivery conveyors. In the event of a detected fault condition downstream of one of the delivery conveyors, the microcomputer generates a control signal to interrupt receipt of assemblages by this one delivery conveyor. Although receipt of assemblages by the one delivery conveyor is interrupted, receipt of assemblages by the other delivery conveyors is maintained.

By maintaining receipt of assemblages by the other delivery conveyors while receipt of assemblages by the one delivery conveyor is interrupted, total machine production is not stopped. The occurrence of the fault condition on the one delivery conveyor shuts down operation of only the one delivery conveyor. Operation of the entire collator is not stopped because of the fault condition associated with the one delivery conveyor. Thus, production of the collator as a whole is optimized during a fault condition downstream of one of the delivery conveyors.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
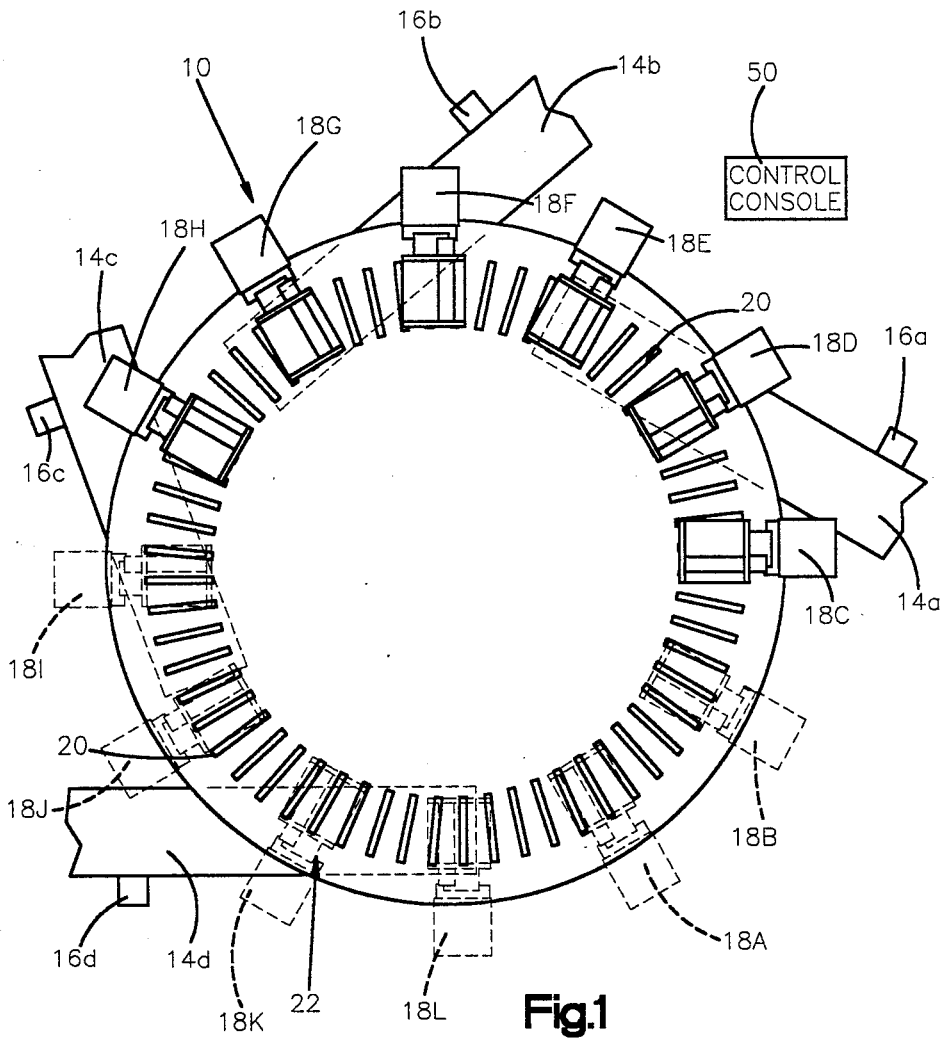
FIG. 1 is a top plan view of a multiple delivery collator incorporating the apparatus and method of the present invention.

A collator 10 having a plurality of delivery conveyors 14 is illustrated in FIG. 1. It is to be understood that there can be any number of delivery conveyors 14. However, for purposes of explanation only, four delivery conveyors 14 designated individually as 14*a*, 14*b*, 14*c* and 14*d* are illustrated. The collator 10 includes a plurality of fault detectors 16 individually designated as 16*a*, 16*b*, 16*c* and 16*d*. Each fault detector is associated with the correspondingly lettered delivery conveyor. If a fault condition occurs downstream of one of the delivery conveyors 14, then the fault detector associated with the particular delivery conveyor detects this occurrence and provides an electrical signal indicative thereof. The structure and operation of such detectors are of conventional design and manufacture and will not be described in detail.

The collator 10 further includes a number of hoppers 18 for feeding signatures to a plurality of gathering stations or pockets 20. The actual number of hoppers can be any number of hoppers. However, for purposes of explanation only, twelve hoppers are illustrated in FIG. 1. The hoppers 18 are individually designated as 18*A* through 18*L*. Five hoppers 18*A* through 18*E* are associated with the delivery conveyor 14*a*. Two hoppers 18*F* and 18*G* are associated with the delivery conveyor 14*b*. Two hoppers 18*H* and 18*I* are associated with the delivery conveyor 14*c*, and three hoppers 18*J*, 18*K* and 18*L* are associated with the delivery conveyor 14*d*.

The plurality of pockets 20 is supported by a rotary turret 22. The rotary turret 22 is of conventional design and manufacture and, therefore, will not be described in detail. One such rotary turret is described in detail in U.S. Pat. No. 3,825,246 entitled "Gathering Machine and Control Therefor", assigned on its face to Harris-Intertype Corporation.

Briefly, the rotary turret 22 has a center axis and a number of roller support and guide stands (not shown). The rotary turret 22 is rotatable on these support and guide stands about the center axis of the rotary turret 22. The rotary turret 22 supports the plurality of pockets 20 for movement around the outer periphery of the rotary turret 22. A motor drive assembly (not shown) is mechanically coupled to the rotary turret 22 for turning the rotary turret 22 about its center axis. The pockets 20 move in a closed, rotary path underneath the plurality of hoppers 18 when the rotary turret 22 rotates about its center axis.

During operation of the collator 10, the hoppers 18 feed a plurality of signatures to the pockets 20. The plurality of signatures are fed from the hoppers 18 to the pockets 20 using a plurality of vacuum-controlled separators (not shown) and grippers (not shown). Each of the hoppers 18 has an associated vacuum-controlled separator and an associated gripper. The use and operation of a vacuum-controlled separator and a gripper in collators are known in the art and need not be described in detail. The delivery conveyors 14 receive groups of collated signatures from the pockets 20 during operation of the collator 10. A group of collated signatures is referred to herein as an assemblage. After an assemblage is formed in each of the pockets 20, the bottom of each pocket opens at a predetermined time synchronized with movement of the pockets 20 along the closed, rotary path under the hoppers 18. When the bottom of one of the pockets 20 opens, the assemblage contained therein drops onto its associated delivery conveyor. This particular delivery conveyor then carries the assemblage downstream to a handling mechanism such as a stacker (not shown).

The hoppers 18 are divided into a number of sectors. The hoppers in a particular sector feed signatures into the pockets 20 to form groups of collated signatures which are subsequently received by one of the delivery conveyors 14. Each sector of hoppers is associated with one delivery conveyor. Thus, the number of sectors is equal to the number of delivery conveyors.

A remote control console 50 houses electronic control circuitry and interfacing devices for controlling operation of the collator 10. This electronic control circuitry monitors the detectors 16 for the occurrence of a fault condition on one of the delivery conveyors 14. The relationship between the control circuitry within the remote control console 50 and different portions of the collator 10 is better illustrated in FIG. 2.

Figure 2:
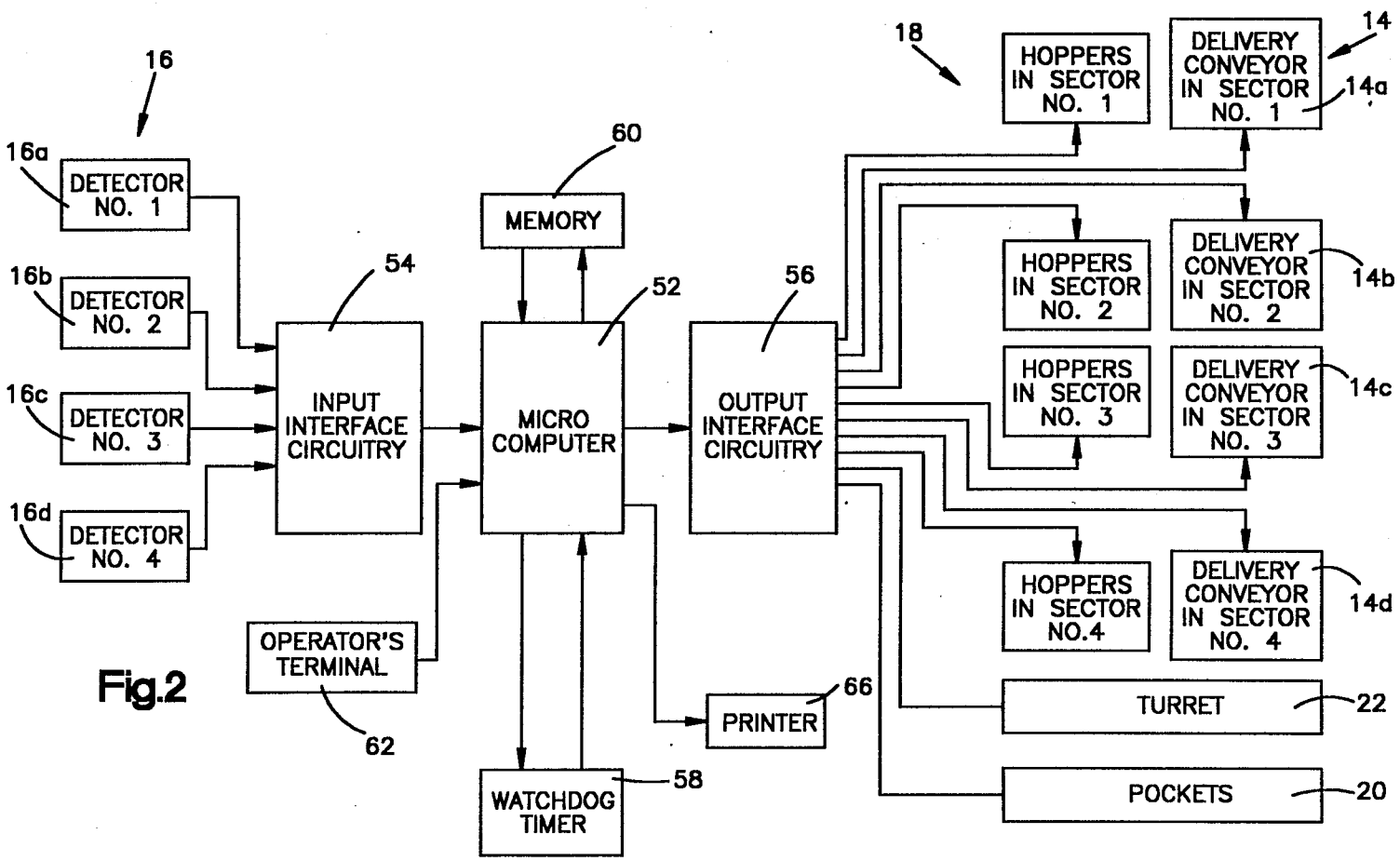
FIG. 2 is a schematic block diagram illustrating electronic control circuitry and interface devices for use in the multiple delivery collator of FIG. 1.

Referring to FIG. 2, the control circuitry includes a microcomputer 52 connected between input interface circuitry 54 and output interface circuitry 56. The microcomputer 52 is electrically connected to a watchdog timer circuit 58. The use of the watchdog timer circuit in combination with the microcomputer 52 is well known in the art and will not be described. A storage memory 60 is electrically connected to the microcomputer 52. The memory 60 stores programs and data associated with controlling operation of the collator 10. An operator's terminal 62 is also electrically connected to the microcomputer 52. The operator's terminal 62 provides a means of accessing and programming the microcomputer 52. The operator's terminal 62 also provides a means of visually displaying data associated with operation of the collator 10. A printer 66 is electrically connected to the microcomputer 52 for providing hardcopy printouts of the data.

The microcomputer 52 monitors the detectors 16 for the occurrence of a fault condition on one of the delivery conveyors 14 through the input interface circuitry 54. In response to these monitored input signals, the microcomputer 52 generates output signals through the output interface circuitry 56 to control the delivery conveyors 14 and the operation of the hoppers 18. The microcomputer also controls operation of the rotary turret 22 and operation of the pockets 20.

If a fault condition is detected downstream of one of the delivery conveyors 20, an electrical signal indicative thereof is generated by the detector associated with this delivery conveyor. The microcomputer 52 responds to this signal indicative of the fault condition by generating an output signal to interrupt receipt of assemblages by the delivery conveyor with the fault condition. Although receipt of assemblages by the delivery conveyor with the fault condition is interrupted, receipt of assemblages by the other delivery conveyors is maintained.

At the moment receipt of assemblages by the one delivery conveyor is interrupted, there exists a cluster of adjacent pockets in which some of the pockets contain incomplete assemblages. During the time that receipt of assemblages by the one delivery conveyor is interrupted, the incomplete assemblages in the cluster of adjacent pockets are completed with continued feeding from the hoppers in the sector associated with the one delivery conveyor having the fault condition. After the incomplete assemblages are completed, the hoppers in the sector associated with the one delivery conveyor stop feeding to the plurality of pockets including the cluster of adjacent pockets.

The completed assemblages are retained in the cluster of adjacent pockets while these pockets continue to move around in the closed, rotary path. The cluster of adjacent pockets continues moving around the closed, rotary path until the fault condition downstream of the one delivery conveyor is cleared. After the fault condition is cleared, receipt of assemblages by the one delivery conveyor resumes. The cooperation between the plurality of pockets and the hoppers in the sector associated with the one delivery conveyor resume normal operation after the one delivery conveyor receives the last of the completed and retained assemblages from the cluster of adjacent pockets.

By maintaining receipt of assemblages by the other delivery conveyors while receipt of assemblages by the one delivery conveyor is interrupted, total machine production is not stopped. Only production in the sector with the downstream fault condition is halted. The other sectors are not halted as a result of this downstream fault condition. Production and delivery continue in the sectors with no fault condition. Throughput in the sectors with no fault condition is thereby maintained. For example, a 75% throughput is maintained for a collator having four delivery conveyors in which there is a fault condition on one of the delivery conveyors. Similarly, if there were two delivery conveyors and one of the delivery conveyors had a fault condition, then a 50% throughput is maintained.

Figure 3:
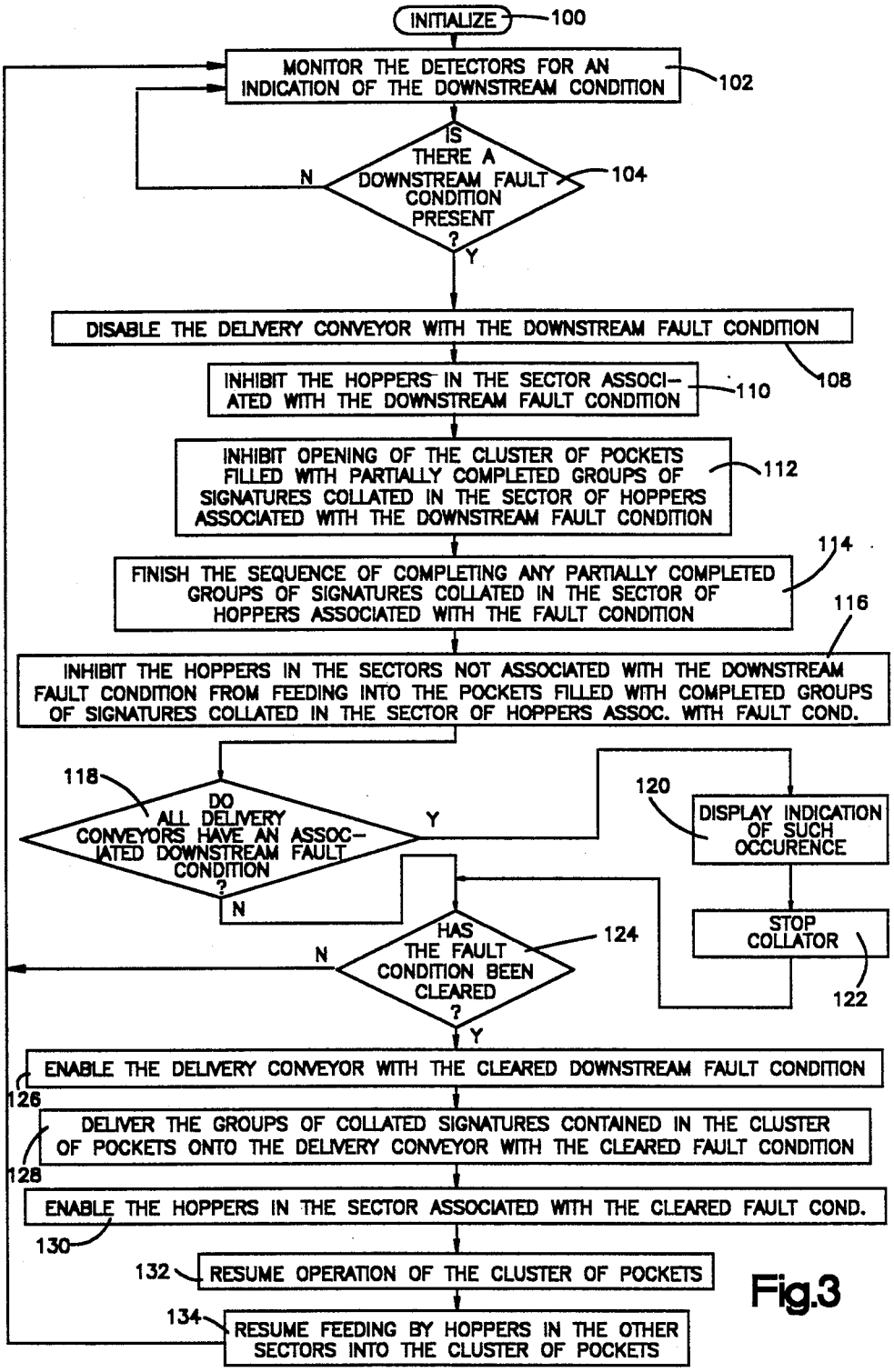
FIG. 3 is a flow chart depicting system operation of the multiple delivery collator in accordance with the present invention.

Referring to FIG. 3, a better understanding of system operation of the collator 10 will be appreciated. The program initializes in step 100. In step 100, the microcomputer 52 performs a plurality of memory tests to determine the operativeness of the microcomputer 52 and the associated electronic circuitry connected thereto. In step 102, the microcomputer 52 monitors the detectors 16 for an indication of a downstream fault condition on one of the delivery conveyors 14. In step 104, a determination is made as to whether a downstream fault condition has occurred on one of the delivery conveyors 14. If the determination in step 104 is in the negative, then the program returns to step 102 to continue monitoring the detectors 16.

If the determination in step 104 is affirmative, then the program proceeds to step 108 to disable the delivery conveyor on which the downstream fault condition occurred. The program then proceeds to step 110 to inhibit the hoppers in the sector associated with the downstream fault condition. At the same time in step 112, the cluster of adjacent pockets filled with partially completed groups of signatures collated in the sector of hoppers associated with the downstream fault condition is inhibited from opening.

Although the cluster of adjacent pockets is prevented from opening to drop the collated signatures contained therein onto the associated delivery conveyor, any partially completed groups of signatures in the cluster of adjacent pockets are allowed to finish the collating sequence. This is indicated in step 114. A complete group of signatures is thereby formed and retained in each of the cluster of adjacent pockets during the existence of the downstream fault condition.

In step 116, the hoppers in the sectors with no fault condition are inhibited from feeding into the cluster of adjacent pockets filled with the completed and retained groups of signatures collated in the sectors of hoppers associated with the downstream fault condition. One way to inhibit the hoppers in the sectors with no fault condition is to stop operation of the associated vacuum-controlled separators. The program then proceeds to step 118 to determine if each delivery conveyor has an associated downstream fault condition. If the determination in step 118 is affirmative, then an indication thereof is displayed on the operator's terminal 62 to warn the operator of such an occurrence as shown in step 120. The collator 10 is then stopped as shown in step 122. Although an indication is displayed on the operator's terminal 62 when each delivery conveyor has an associated downstream fault condition, it is possible that the program could include another step in which an indication is provided when downstream fault conditions occur on less than all of the delivery conveyors. The program proceeds to step 124 from either step 122 or a negative determination in step 118.

In step 122, the program determines if the downstream fault condition on the one delivery conveyor has been cleared. If the determination in step 122 is in the negative, then the program returns to step 102 to continue monitoring the detectors 16 for an indication of a downstream fault condition on one of the delivery conveyors 14. If the determination in step 122 is affirmative, then the program proceeds to step 126 to enable the delivery conveyor with the cleared downstream fault condition. The program then proceeds to step 128 to deliver the completed and retained groups of collated signatures contained in the cluster of adjacent pockets onto the associated delivery conveyor. The program then proceeds to step 130 to enable the hoppers in the sector associated with the cleared fault condition so that the hoppers may resume normal operation.

In step 132, the cluster of adjacent pockets resume normal operation to receive groups of collated signatures from the sectors with no fault condition. In step 134, the feeding by hoppers from the sectors with no fault condition into the cluster of adjacent pockets resumes. The program then returns to step 102 to continue monitoring the detectors 16 for an occurrence of a downstream fault condition on one of the delivery conveyors 14.

The preferred embodiment described hereinabove is a collator of the circular type in which the pockets supported by the rotary turret move around in a circular path. It is also conceivable that the collator may be of the straightline type in which the pockets are supported for movement in a straight line past a number of gripper conveyors.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, I claim:

1. An apparatus for controlling a collator having a plurality of hoppers for feeding a plurality of signatures to a plurality of gathering stations movable past the hoppers and at least two delivery conveyors for receiving groups of signatures collated in sectors of the plurality of hoppers, said apparatus comprising:

means for detecting a fault condition downstream of one of the plurality of delivery conveyors; and means responsive to said detector means for interrupting receipt by the one delivery conveyor of groups of signatures collated in a sector of the plurality of hoppers associated with the one delivery conveyor while maintaining receipt by the other delivery conveyor of groups of signatures collated in another sector of the plurality of hoppers associated with the other delivery conveyor.

2. The apparatus of claim 1 further including means for completing partially completed groups of collated signatures contained in some of the plurality of gathering stations and means for retaining the completed groups of collated signatures contained in some of the plurality of gathering stations while receipt by the one delivery conveyor of groups of collated signatures is interrupted.

3. The apparatus of claim 1 wherein said detector means includes means for generating a first electrical signal indicative of the fault condition downstream of one of the plurality of delivery conveyors.

4. The apparatus of claim 3 wherein said interruptor means includes a microcomputer for generating a second electrical signal in response to said first electrical signal indicative of the fault condition downstream of one of the plurality of delivery conveyors, the receipt of groups of collated signatures by the one delivery conveyor on which the downstream fault condition is detected varying as a function of said second electrical signal.

5. A method for controlling a collator having a plurality of hoppers for feeding a plurality of signatures to a plurality of gathering stations movable past the hoppers and at least two delivery conveyors for receiving groups of signatures collated in sectors of the plurality of hoppers, said method comprising the steps of:

(a) detecting a fault condition downstream of one of the plurality of delivery conveyors;

(b) interrupting receipt by the one delivery conveyor of groups of signatures collated in a sector of the plurality of hoppers associated with the one delivery conveyor while maintaining receipt by the other delivery conveyor of groups of signatures collated in another sector of the plurality of hoppers associated with the other delivery conveyor.

* * * * *